US007938152B2

(12) United States Patent
Jenne

(10) Patent No.: US 7,938,152 B2
(45) Date of Patent: May 10, 2011

(54) BEVERAGE FILLING MACHINE LOCK LEVER AND METHODS FOR USE

(75) Inventor: Richard D. Jenne, Willowick, OH (US)

(73) Assignee: Bevcorp, LLC, Willoughby, OH (US)

( * ) Notice: Subject to any disclaimer, the term of this patent is extended or adjusted under 35 U.S.C. 154(b) by 932 days.

(21) Appl. No.: 11/779,473

(22) Filed: Jul. 18, 2007

(65) Prior Publication Data

US 2008/0236215 A1 Oct. 2, 2008

Related U.S. Application Data

(63) Continuation-in-part of application No. 11/692,570, filed on Mar. 28, 2007.

(51) Int. Cl.
*B65B 3/04* (2006.01)

(52) U.S. Cl. ..... 141/148; 141/150; 53/90

(58) Field of Classification Search ..... 141/148–150; 53/90, 253

See application file for complete search history.

(56) References Cited

U.S. PATENT DOCUMENTS

| | | | | |
|---|---|---|---|---|
| 2,519,353 | A | | 8/1950 | Cassady |
| 2,822,943 | A | | 2/1958 | Fedorchak |
| 2,958,346 | A | | 11/1960 | Kerr |
| 3,040,787 | A | | 6/1962 | Knoll |
| 3,245,436 | A | | 4/1966 | Burgert, Jr. |
| 3,716,693 | A | | 2/1973 | Bleckmann |
| 3,826,293 | A | | 7/1974 | Cayton |
| 4,522,238 | A | | 6/1985 | Minard |
| 4,643,141 | A | | 2/1987 | Bledsoe |
| 4,721,200 | A | | 1/1988 | Dugan |
| 4,737,801 | A | * | 4/1988 | Ichihashi et al. ..... 347/85 |
| 4,918,902 | A | | 4/1990 | Honma et al. |
| 5,042,536 | A | | 8/1991 | Petri et al. |
| 5,145,008 | A | | 9/1992 | Yun |
| 5,189,928 | A | | 3/1993 | Ontrop et al. |
| 5,351,576 | A | | 10/1994 | Matsui et al. |
| 5,413,153 | A | | 5/1995 | Zwilling et al. |
| 5,469,899 | A | | 11/1995 | Nish |
| 5,642,764 | A | | 7/1997 | Nish |
| 5,865,070 | A | | 2/1999 | Bornhorst et al. |
| 5,924,462 | A | | 7/1999 | McKaughan |
| 5,944,072 | A | | 8/1999 | Tietz et al. |
| 6,076,567 | A | | 6/2000 | Naecker et al. |
| 6,109,483 | A | | 8/2000 | Wilke et al. |
| 6,131,624 | A | | 10/2000 | Paradies |
| 6,135,166 | A | | 10/2000 | Paradies et al. |
| 6,263,925 | B1 | | 7/2001 | Olsen |
| 6,415,754 | B1 | | 7/2002 | Hirano et al. |
| 6,647,869 | B2 | | 11/2003 | Bornhorst et al. |
| 7,127,870 | B2 | | 10/2006 | McRay et al. |

* cited by examiner

*Primary Examiner* — Gregory L Huson
*Assistant Examiner* — Nicolas A Arnett
(74) *Attorney, Agent, or Firm* — Hahn Loeser & Parks LLP

(57) ABSTRACT

The invention is directed to lock levers for use in an automatic beverage machine for filling cans for example. The lock lever may have an L-shaped configuration with a first and second leg, and a first engagement surface on a side of the second leg which transitions to a second engagement surface at the distal end of the second leg. The lock lever is selectively rotated between operational and non-operational positions, and the first engagement surface transitions into the second engagement surface. The transition from the first engagement surface to the second engagement surface positions the second engagement surface at a predetermined height without the first or second engagement surface extending above the predetermined height.

8 Claims, 4 Drawing Sheets

BEVERAGE FILLING MACHINE LOCK LEVER AND METHODS FOR USE

TECHNICAL FIELD

The invention relates to a lock lever, and system and method for using a plurality of lock levers in an automated beverage can filling machine. More particularly, lock levers according to the invention may be used to initially set up an automated beverage can filling machine in an extremely simple and effective manner, and to facilitate subsequent maintenance activities for the beverage filling machine. The lock levers of the invention also provide for better performance during the filling process. A method of the invention allows for proper and accurate set up of the automated beverage can filling machine in a simplified manner, and avoid problems if lock levers need to be replaced during maintenance procedures. The ability to accurately set up the machine relating to the lock levers associated therewith provide the user with significant advantages relative to past approaches.

BACKGROUND OF THE INVENTION

Containers for filling with a beverage, such as cans for carbonated soft drinks and beer, are now produced with very thin gauge materials, such as aluminum. Due to the cost of the cans or the like, the use of less material in forming the can is desired, but has led to problems when filling the can with a beverage using high speed automated beverage filling machines and equipment. Such containers have also been configured with a necked down region at the top of the cans to define a reduced diameter opening, thereby reducing size of the cap needed for closure thereof.

In a high speed automated beverage filling machine, the filling of a can is performed by positioning the can into a filling position relative to a filling valve. For high speed operation, the filling stations are rotated at high speed and cans are sequentially introduced to the filling machine from a conveyor system for filling, and then removed for further processing steps. Upon positioning of the can in a filling station and sealing in association with a filling valve, the can is first charged with carbon dioxide to counter pressure the can, and then an amount of a beverage is introduced therein, such as from an elevated beverage bowl. After filling, the filled can is snifted to remove any remaining gases under pressure. Thereafter, the can may be removed from the filling valve and subsequent capping or other processes are performed.

During filling, the cans are generally lifted into a filling position via a platform, relative to a filling valve, and the necked down top is engaged by a sealing gasket associated with the filling valve. To prevent leakage, the sealing gasket engages the top of the can with some force for proper sealing. If the position of the can relative to the sealing gasket and filling valve is not accurate when lifted into position by a lifting platform, this can result in damage to the can. With the thinner side walls and necked down region at the top, cans may be damaged during the filling process such as by buckling, crimping or crinkling, particularly at higher fill speeds. Damage to cans during filling causes significant problems such as lower production, leakage or costs of discarding materials or product, limiting production and/or making production costs higher. Prior practice was to install a set of lock levers in a filler, then shim the structures, such as the bowl height, utilizing shims under the bowl stanchions located in a circular pattern around the bowl. Shims would be added or subtracted until the valves in front of the stanchions measured out to the desired height + or −0.005 inches for example. These attempts may still result in the valves between the stanchion being out of the + or − range as described. Any differential from the desired position is detrimental to the filling operation as a slight deviation in this range will cause a short fill or an over filled can, whereas a larger deviation will cause the can side wall to buckle or the can will not fill at all.

Alternatively, the proper positioning of the support platform on which a can rests relative to a filling station is adjusted to properly position a can thereon relative to the fill valve, and avoid damage to cans or problems in filling. The function of the lock levers on a can filling machine is to provide a device which is used to fix or lock the height of the platform the empty can sits on in relation to the filling valve located directly above a respective filling station. This is important for correct operation of the filling process at all stations around the multiple station filler.

Prior practice was to measure each fill station as to the position or height of the lift platform in association with a filler. If any fill stations did not have the desired height of the platform, installers have attempted to shim the beverage bowl height utilizing shims under the bowl stanchions located at intervals around the bowl. Shims would be added or subtracted until the valves in front of the stanchions measured out to the desired height within a predetermined tolerance. Although this may result in correction of problems at or directly adjacent a bowl stanchion, fill valves situated between the stanchions could still be out of the tolerance range. This differential is detrimental to the filling operation as a slight deviation in this range will cause a short fill or an over filled can, cause the can side wall to buckle or otherwise deform, or result in the can not filling at all. Any such occurrences or problems are very costly and wasteful to an efficient and effective filling process. Due to such parameters, or others, such as the tolerances of the piston support ring associated with the platform lift cylinder, beverage bowl dimensional fluctuations or other structures or dimensional characteristics associated with the automated filling machine, the fill positions of each of the platforms can vary, requiring a different required positioning of an associated lock lever. Another attempt by installers to correct these problems was by adjusting the position of lock lever support surface, by shimming or shaving material from the lock lever. Such an approach is labor intensive and no simple solutions have been developed. In a further attempt, there has been provided an adjustable eccentric pivot post that the lock lever rotates around. This approach still requires every station to be measured and set to the correct height every time the lock lever is installed or replaced, or where the adjustment eccentric moves from its set position. It is common for the eccentric adjustment device to rotate over a period of time, resulting in making that fill station out of tolerance. It would be desirable to avoid the need for performing such adjustments on the fly during installation or replacement, and provide an easier method of adjusting the position of a lift platform of a fill station in association with a lock lever in an automated beverage filling machine.

One other detriment to the standard lock lever is that as the lock lever is being rotated to its proper position, there is a point approximately five degrees prior to the operative location of the lock lever where the platform is raised 0.020 to 0.030 inches higher than the desired height or height range. This can result in problems of jolting a portion of the beverage in the container such that it escapes the container before filling is completed, or possible damage to the can. It would be desirable to provide a lock lever which avoids this unwanted raising of the platform beyond the desired height.

Also, in the use of lock levers in association with automated beverage filling machines, the levers periodically must be replaced. Presently, there is no solution for simple replacement of a lock lever when needed. Depending on the initial set up parameters associated with each lock lever in a machine, if adjustments were made during initial set up, any replacement lock lever must also be adjusted, requiring the maintenance personnel to independently determine if an adjustment is necessary, and if so, what adjustment is necessary to position the lock lever and therefore the lift platform at the proper position. It would therefore be desirable to provide a system and method for simple and effective maintenance and replacement of lock levers associated with a particular filling machine.

SUMMARY

Based on the foregoing, the present invention overcomes or substantially eliminates the problems associated with this positioning of a can at the wrong position relative to a fill head, as well as provides a simple but effective system and method for initial installation of lock levers in set up of a filling machine and/or subsequent replacement of a lock lever during maintenance of the machine. The lock lever of the invention also provides improved structure for improved performance during filling procedures.

In an example, the invention is directed to a lock lever for use in an automatic beverage machine for filling cans. The machine generally includes a platform lift cylinder assembly, a filling valve having a filling seal, with a lock lever positioned in association with the platform lift cylinder assembly. The lock lever is mounted to be rotated between operational and non-operational positions. The lock lever of the invention comprises in an embodiment an L-shaped configuration with a first and second leg, with the first and second leg being coupled by a corner portion. A first engagement surface is formed on the outer surface of one of the legs and transitions to a second engagement surface on the distal end of the leg. The lock lever is selectively rotated between operational and non-operational positions. The transition from the first engagement surface to the second engagement surface positions the second engagement surface at a predetermined height without the first or second engagement surface extending above the predetermined height. In an example, the transition from the engagement surface to the outer surface of the leg utilizes a first radius extending from the corner region and a second blending radius extending from the first radius to the engagement surface. The second radius may be less than the first radius so as to remove material from this region adjacent the engagement surface. In an alternative embodiment, the lock lever of the invention comprises in an example a generally L-shaped configuration with a first and second leg, with the first and second leg being coupled by a corner portion. One of the first or second legs comprises an engagement surface at its distal end. The engagement surface is offset at the upper portion of the lock lever above the pivot point from the corner portion to the engagement surface at the outer end of the leg, to remove material from this region.

The invention is also directed to a method for installation in association with a filling machine, comprising the steps of supplying a plurality of lock levers for installation in association with a filling machine, the plurality of lock levers comprising a regular size lock lever with a first dimension associated with the height of the engagement surface relative to the axis of rotation of the lever, and at least one other lock lever having a second dimension associated with the height of the engagement surface relative to the axis of rotation of the lever, with the second dimension being one of a reduced or increased dimension relative to the first dimension. The at least one other lock lever enables use thereof to accommodate any difference in positioning of an associated lift platform from a predetermined height relative to the filling valve, with the second dimension substantially correcting the height to the predetermined height.

An embodiment also provides a system for installation and/or replacement of lock levers associated with a filling machine, comprising a kit of a plurality of lock levers for installation in association with a filling machine, the plurality of levers comprising a plurality of regular size levers with a first dimension associated with the height of the engagement surface relative to the axis of rotation of the lever, and at least one other lock lever having a second dimension associated with the height of the engagement surface relative to the axis of rotation of the lever. The second dimension being one of a reduced or increased dimension relative to the first dimension of the regular size lock lever. The at least one other lock lever enables use for installation to selectively vary the resulting height of an associated lift platform from the first dimension associated with the regular lock levers, or during replacement to replace an installed other lock lever with a like other lock lever, without requiring determination of the height of the lift platform required at a predetermined fill station. In an example, a plurality of first regular size levers are provided, along with a plurality of other size levers having different second dimensions to accommodate expected differences from the predetermined height. In this way, if a particular lift platform station is not at the correct predetermined height relative to a filling valve, one of the plurality of other size levers, having a second dimension to accommodate the difference from the predetermined height is easily selected and installed to correct the height of the lift platform. Depending on the second dimension of the other size levers provided, they each can be color coded or otherwise indicated to have one of a predetermined number of second dimensions correlating to expected errors in the platform heights from the predetermined height. For initial installation of levers, if a particular lift platform deviates from the predetermined height, a lock lever having dimensions to correct for this is easily selected from the group of provided other size levers, one of which will have a second dimension to bring the platform height back within desired tolerances. Thereafter, upon the need for subsequent replacement of a lever, a replacement lock lever having the same second dimension as the installed lock lever is easily selected. If the levers are color coded or otherwise simply indicated per their particular second dimension, replacement is simply choosing a similar color lock lever for installation at that particular filling station. The set of other size levers may provide standard deviations from the predetermined height and first dimension associated with regular size lever, for example in increments, to accommodate variations that may be found in association with installations of filling machines.

These and other objects and features of the present invention will be apparent from the detailed description taken with reference to accompanying drawings.

DETAILED DESCRIPTION

Figure 1:
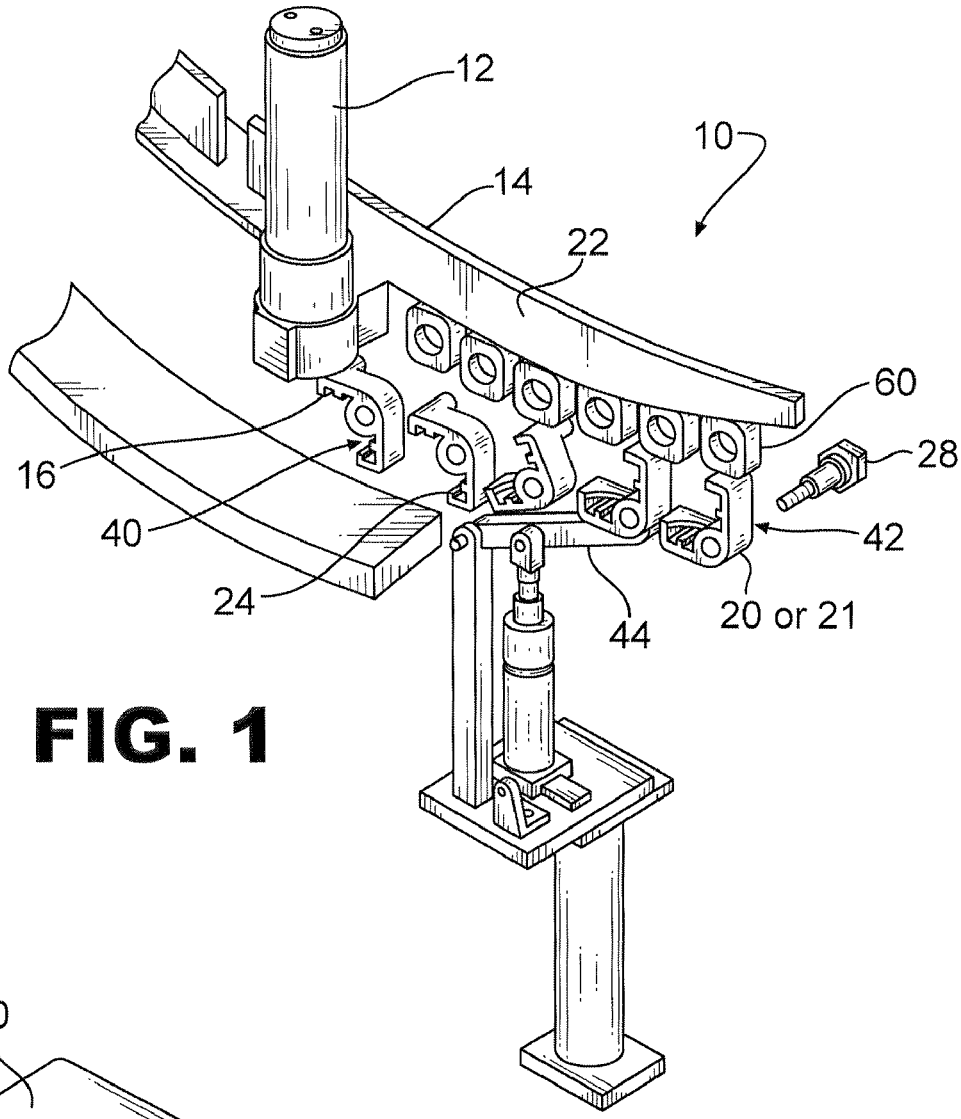
FIG. 1 is a partial perspective view of a portion of a filling machine showing a plurality of lock levers mounted in association with the filling machine.

Automatic beverage filling machines have been used for many years in high speed filling operations, for beverages such as beer and carbonated drinks as an example. In FIG. 1, there is shown a portion of a beverage filling machine 10, relating to one of a plurality of filling stations having associated fill valves (not shown) for filling individual cans or other containers with a beverage. The construction and operation of the filling machine 10 is generally known, and no description is made in relation to various features thereof.

The machine 10 rotates during filling, and has a plurality of platform lift cylinder assemblies 12, one being shown in FIG. 1, situated around the machine 10. Mounted on top of each platform lift cylinder assembly 12 is a lift platform (not shown) upon which a can or other container to be filled is placed relative to a fill head (not shown). The plurality of lift cylinders 12 are arranged adjacent one another and turn along with the automatic beverage filling machine 10. Each platform lift cylinder assembly 12, is spring loaded so that the cylinder assembly 12 is forced in an upward direction to a predetermined position. The lift platform cylinder assembly 12 is selectively lowered for positioning of a can or other container thereon for filling, and follows a stationary cam member 14. The cam member 14 selectively lowers the cylinder assembly 12 down against the extending spring force, and allows an empty can or container to be selectively inserted on the associated lift platform in a position for filling.

Figure 2:
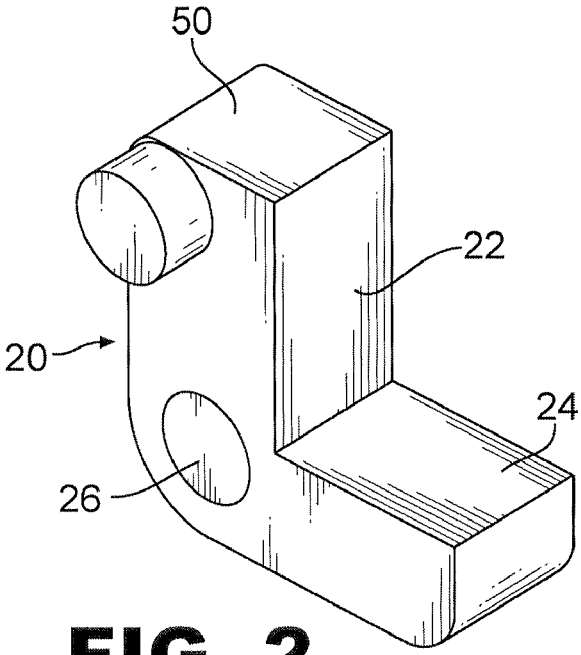
FIG. 2 is a perspective view of a lock lever according to an example of the invention.

A plurality of lock levers 20 or 21 (one being shown in FIG. 1 as it moves in rotation with machine 10) are provided to selectively position the cylinder lift assembly 12 and associated platform (not shown for clarity) at a predetermined height, and prevent downward movement during filling. As will be hereinafter described in more detail, the lock levers 20 or 21 represent regular size lock levers 20 and at least one other size lock lever 21. The lock levers 20 or 21 are generally L-shaped as shown in FIG. 2 with a first leg 22 and second leg 24, and have a corner region with a mounting aperture 26. The lock levers 20 or 21 are secured in position by a concentric shoulder bolt 28 (FIG. 1) at the corner region 26 thereof. During the time where the cylinder 12 is lowered by engagement with cam member 14, an associated lock lever 20 or 21 is rotated about its rotational axis 70 (FIG. 4) at the shoulder bolt 28 to its inoperative position 40 shown in FIG. 1, such that the lock lever 20 or 21 is positioned below the cylinder assembly 12 without contact between the lock lever 20 or 21 and the base 60 (FIG. 1) associated with the cylinder assembly 12 at this location. As the machine 10 continues to turn, leg 24 of lock lever 20 or 21 engages a cam member 44, which causes it to rotate about the corner region 26 in a clockwise direction through about 90 degrees of rotation from the left position 40 shown in FIG. 1 to the operative position shown at 42 to the right in FIG. 1. In the operative position 42, leg 24 is rotated to be substantially horizontally disposed, with leg 22 substantially vertically disposed. As the lock lever 20 or 21 is rotated by cam 44, an upper engagement surface 50 associated with leg 22 is substantially horizontally disposed, and engages in the position 42 shown in FIG. 1, the bottom surface of the offset base member 60 associated with and secured to the cylinder assembly 12. The positioning of engagement surface 50 controls the position of the base member 60 and in turn the position or height of the cylinder assembly 12 and associated platform (not shown) on which a can or container is positioned for filling. This height or position is designed to be at a predetermined height within a predetermined tolerance for proper operation of the filling machine 10.

As the cylinder assembly 12 and associated lock lever 20 or 21 moves from the inoperative position 40 where a can or the like is positioned thereon, to the operative position 42 illustrated in FIG. 1, the engagement of the cylinder assembly 12 with the cam member 14 terminates, and the spring force of cylinder assembly 12 with a can on its platform, moves the platform and can upward to a desired sealing position relative to a fill head (not shown). After sealing with the fill head, the filling procedure takes place. The filling procedure generally comprises counter-pressuring the empty can with carbon dioxide, dispensing an amount of beverage into the can, and snifting residual gases from the top of the can, and then closing the can with a lid. Subsequent to filling and closing with a lid, the filled can and cylinder assembly 12 on which it is supported continue to rotate with the associated lock lever 20 or 21, and the lock lever 20 or 21 remains in its operative position until leg 22 is caused to rotate counter-clockwise approximately 90 degrees by a cam member (not shown) to its inoperative position, wherein the filled can is removed and the process is ready to begin again with a new can.

The lock levers 20 or 21 rotate concentrically, and are incapable of adjustment without modification of the lock lever itself, to fix the position of the lock lever 20 or 21 once installed. The lock levers 20 or 21 and engagement surface 50 associated therewith support the bottom of a platform lift cylinder assembly 12 when the lock lever is in its operative position. Each lock lever 20 or 21 is designed, when in its operative position, to prevent downward movement of the platform lift cylinder assembly 12 during filling of a can positioned thereon. Any such downward movement may cause undesirable separation of the seal between the can and filling valve. Without lock levers 20 or 21, the force of the counter pressure carbon dioxide and/or the dispensing of beverage into the can during the filling operation could displace the associated lift cylinder assembly downward allowing separation between the lip of the can and the fill valve seal. The lock levers 20 or 21 prevent this unwanted movement during the filling operation.

In initial installation of a beverage filling machine 10, each lift cylinder assembly 12 and associated platform is properly positioned relative to a fill head to provide for sealing of the can with the fill head without damage to the can. In machine setup, the installer therefore has in the past had to measure the position of the lift cylinder assembly 12 and associated platform which should be at a predetermined height within a predetermined tolerance. The position of the lift cylinder assembly 12 is controlled by the position and dimensions of the lock lever 20 or 21 associated therewith. In the system and method of the invention, a plurality of regular size lock levers 20 are provided for installation if the predetermined height of the lift cylinder assembly 12 and associated platform is within predetermined tolerances. If the measured position is not within tolerance to the predetermined position, the position must be corrected accordingly, and as will be described further, at least one other size lock lever 21 is used to make such a correction.

Figure 4:
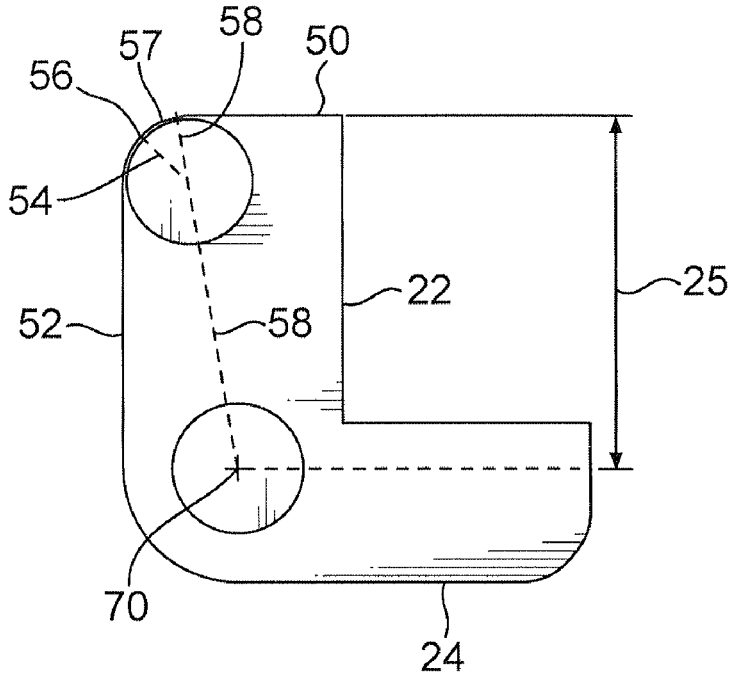
FIG. 4 is a side view of the lock lever shown in FIG. 2.

The invention therefore provides a system and methods for allowing the position of a lift cylinder assembly 12 to be modified by at least one other size lock lever 21 having different dimensions from the regular size lock lever 20 to account for the difference in the position of the lift cylinder assembly 12 and associated platform. As shown in FIG. 4, the dimension 25, being from the axis of rotation 70 of the lock lever 20 or 21 to the engagement surface 50, will be a predetermined first dimension 25 for a regular size lock lever 20. The invention then provides at least one other size lock lever 21 having a second dimension 25, which is distinct from the regular size lock lever 20. Generally, a plurality of other size lock levers 21 can be provided with various dimensions 25 which are predetermined amounts greater and less than the first dimension 25 of the regular size lock lever 20.

Figure 3:
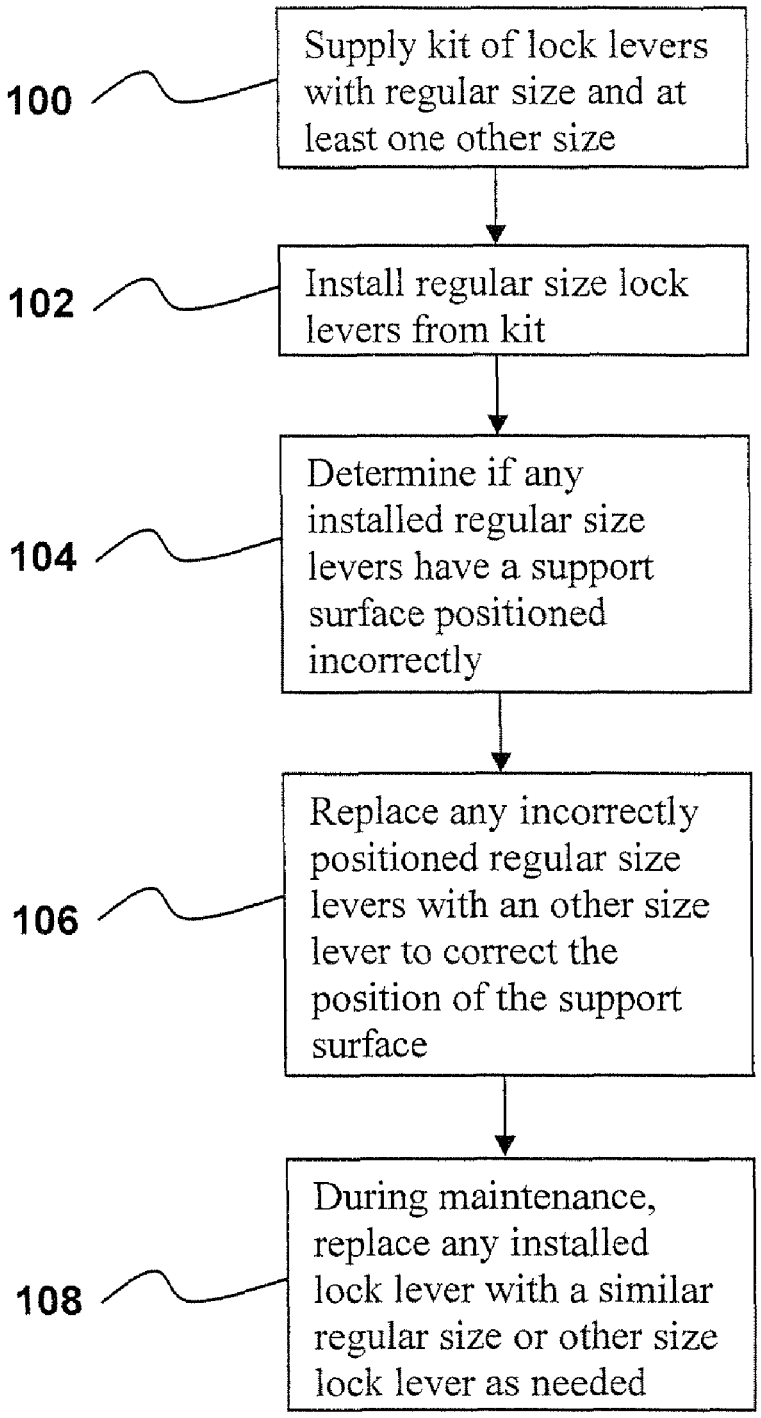
FIG. 3 is a diagram of a method and kit providing a plurality of lock levers for installation or replacement in association with a filling machine.

With reference to FIG. 3, there is shown an example of a method for installing lock levers and a system or kit and method for use in installing lock levers in association with a filling machine. To simplify installation, a kit may comprise a complete set of the regular size lock levers 20 having a predetermined first dimension 25, and a plurality of other lock levers 21 having incrementally increased or decreased dimensions 25 relative to the regular lock lever 20, are provided at 100. The user installs a set of regular size lock levers 20 in place using concentric shoulder bolts at 102. Each station is then checked to determine whether a engagement surface 50 is positioned at the correct height or if any installed lever 20 is positioned incorrectly at 104. For any stations which require a change in the height of engagement surface 50 to position the associated lift cylinder assembly 12 and associated platform at the proper position, the difference from the dimension 25 of a regular size lock lever 20 is determined and the regular size lock lever 20 is replaced at 106 with an other size lock lever 21 to correct the position of the engagement surface 50 at that station. The dimension 25 of the other size lock lever 21 is chosen to correct the ultimate position of the lift cylinder assembly 12 and associated platform. To facilitate this, the regular size levers and other size levers 20 may have an indicator to show whether they are a regular size lock lever 20 or one of various incrementally increased or decreased dimension other size lock levers 21. At a later date, when the installed levers 20 or 21 require changing, the user may simply replace each station lock lever with the same color or otherwise uniquely indicated lock lever 20 at 108. It should be recognized that any other suitable indication associated with the regular size 20 and other sizes of lock levers 21 may be used. A log may even be used to indicate where any other size lock levers 21 are used, and what size these were as compared to a regular size lock lever 20, for facilitating subsequent replacement with the same size lock lever 20 or 21. In this way, the need to measure each station is not required. Further, the position of the engagement surface 50 is fixed, and cannot be adjusted in association with a given lock lever 20 or 21 once installed, such that this position cannot be changed while running production, such as can occur with an eccentric shoulder bolt adjustment mechanism associated with a lock lever 20. Further, although the method described avoids the need to measure any station as to discrepancies of the lift cylinder assembly 12 and associated platform from a desired position, the initial installation of a regular size lock lever 20 may not be needed if the amount of correction needed at a station is determined otherwise, and instead the corrective other size of lock lever 21 can simply be installed.

Subsequent to initial installation of lock levers 20 or 21, in the course of operating the filling machine 10, due to the environment and materials, the dimension 25 associated with any lock lever 20 or 21 can change (typically increasing due to expansion of the nylon used to form the lock lever 20 or 21), thereby deviating from the desired positioning of the lift cylinder assembly 12 and associated platform. Thus, during maintenance or repair activities, any lock levers which are causing any deviation from the predetermined position of lift cylinder assembly 12 and associated platform are replaced. The process to repair or maintain a filling machine is simplified according to the present invention, as each lock lever 20 or 21 as originally installed properly positioned the lift cylinder assembly 12 and associated platform, and simply can be replaced by a lock lever 20 or 21 having the same dimensions as that lock lever originally installed. To facilitate this, the plurality of lock levers provided for installation and/or repair or maintenance again may include an indicator associated therewith to indicate the dimension 25 of the lock lever. Each lever 20 or 21 may have an indicator showing it as a regular size 20 or one of the other size levers 21 having a predetermined greater or reduced dimension 25 relative to the first dimension of a regular size lock lever 20. As an example, the indicator may be color coding of the lock levers, with the regular size lock lever having one color for each of the other size levers using different colors signifying each greater or reduced dimension 25 associated therewith.

In this way, dependent on any deviation from the predetermined position of the lift cylinder assembly 12 and associated platform, one of the other lock levers having a greater or lesser dimension 25 is selected to properly position the lift cylinder assembly 12 and associated platform. Adjustment of the position of the lift cylinder assembly 12 and associated platform is easily accomplished without attempting to modify the dimension 25 of a regular size lock lever 20 by shimming or shaving material therefrom. The lock levers 20 or 21 require no individual adjustment, as each has a fixed dimension 25.

Turning to FIG. 4, the lock lever 20 or 21 is shown in more detail. The axis of rotation 70 of the lock lever 20 or 21 is the center of the aperture 26, as the lock lever 20 or 21 rotates substantially 90 degrees into and out of its operative and inoperative positions. The dimension 25 as previously described is from the axis of rotation 70 or center line of aperture 26 to the plane of the engagement surface 50 of the lock lever 20 or 21. This dimension 25 is a set point and is desired to be held to within a predetermined tolerance, such as for example within 0.005 inch total from a predetermined dimension. For example, with many types of filling machines 10, the dimension 25 has been held at 2.000+0.002−0.002 inches for regular size lock levers 20. By changing the dimension 25 in predetermined increments, for example in increments of plus 0.010 inches and minus 0.010 inches, any deviations from the predetermined position of the engagement surface 50 when installed on a filling machine 10 can be corrected using one of the other size lock levers 21. The incremental second dimensions associated with the dimension 25 are chosen to account for any deviation of the improper positioning of the lift cylinder assembly 12 and associated platform. Each different lock lever 21 with a different incremental dimension 25 may then be color coded or otherwise provided with an indication for each incremental increased or decreased dimension 25. For example, nine different color lock levers would yield nine different incremental dimensions 25, with some being incrementally reduced or increased relative to the predetermined first dimension 25 associated with a regular size lock lever 20. In an example, the first dimension 25 associated with regular size lock lever may be approximately 2.00 inches, and generally is acceptable if within a tolerance of plus or minus 0.002 inches. For the other size lock levers, increments or 0.010 inches above or below the regular size lock lever may be provided, such that other size lock levers have an increased second dimension of 2.010, 2.020, 2.030, 2.040, etc. inches, as well as reduced dimensions of 1.990, 1.980, 1.970, 1.960, etc. inches for example. With this approach, each lock lever engagement surface and therefore station of the filling machine can be selectively raised or lowered a predetermined total distance, such as 0.080 inches, while maintaining a predetermined tolerance, such as + or −0.005 inches as an example.

Figure 5:
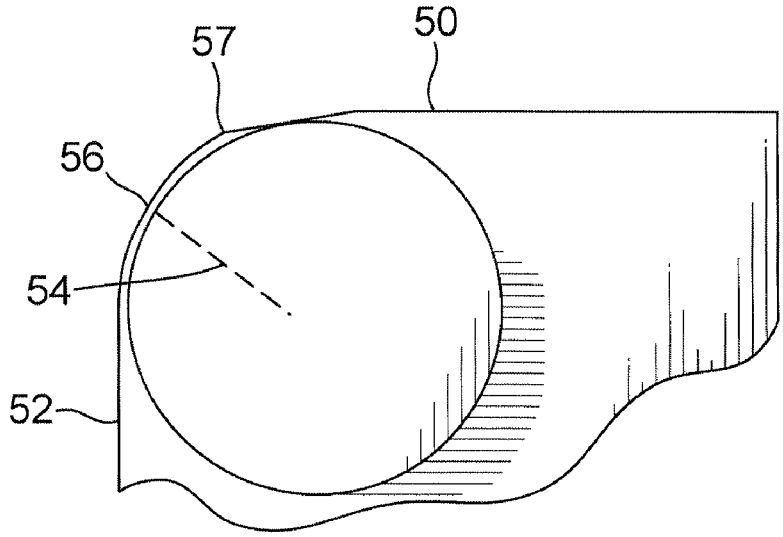
FIG. 5 is partial enlarged side view of the lock lever as shown in FIG. 4.

Further, with reference to FIGS. 4 and 5, a problem with past designs of lock levers is alleviated. This problem in past designs occurs during rotation of the lock lever to its operative position as described previously. As the past lock lever rotated to the operative position, there was a point approximately 5 degrees prior to the operative position of the lever, where due to its configuration the lock lever causes the platform to be raised 0.020 to 0.030 inches higher than the desired position, until the lock lever rotates the additional 5 degrees. This has been due to the use of a constant radius transition between the side 52 of leg 22 and the engagement surface 50.

The over travel of the platform during the rotation occurs as follows. The radius marked 54 is a predetermined radius, such as a 0.375 inch radius, that blends into the flat plane of engagement surface 50 on a past lock lever design. Dimension 25 is a predetermined dimension and in turn sets a predetermined dimension between the axis of rotation 70 and the outer edge at 56 of the lock lever 20 or 21 at the radius 54. For example, if the dimension 25 is set at 2.00 inches, the dimension from the axis of rotation 70 and outer edge of the lock lever at 56 on radius 54 will be a minimum of 2.025 inches. As the lock lever 20 or 21 rotates, point 56 contacts the mating surface of the lift cylinder assembly 12 and associated platform and starts to raise the platform. During the rotation, if a constant radius 54 is used, point 57 has full contact, which causes unnecessary and undesirable over travel at the end of rotation surface until the engagement surface 50 is positioned to support the mating surface of the lift cylinder assembly 12 and associated platform.

To alleviate this problem, in accordance with an example of the invention, at location 57, a second radius 58 is blended with radius 54, and extends from the axis of rotation 70 with a dimension slightly larger than dimension 25 of the lock lever 20 or 21. The radius 58 may be a small incremental additional distance than dimension 25, such as for example the dimension 25 plus 0.005 inches. For example, if the dimension 25 is set at 2.00 inches, the blending radius 58 may be 2.005 inches and extends between point 57 on radius 58, and the flat engagement surface 50. In this way, any over travel of the platform as described previously is eliminated. The blending radius 58 varies with variations in the dimension 25 to alleviate potential over travel of the platform with which it is associated. The second radius may therefore be related to the dimension between the rotational axis and the second engagement surface of the lock lever and is the same or greater than the dimension between the rotational axis and the second engagement surface by an amount up to 0.025 inches, or greater by 0.010 to 0.015 inches for example.

This problem of over travel of the platform also is a detriment when the lock lever rotates 90 degrees from the operative position to the inoperative position. During this action, the can has already been filled with a carbonated beverage, and does not respond well to a sudden jolt caused by the over travel problem noted. This jolt can cause some the product in the can to splash up above the top opening of the can, and due to the high speed of filling machines, the can may pull down from sealing engagement with the fill valve before the product can return into the can. Due to the centrifugal force of the rotary filler, this can cause some of the product to be ejected from the can thereby creating waste. The provision of a second radius 58 extending from point 57 to surface 50 alleviates this problem.

Figure 6:
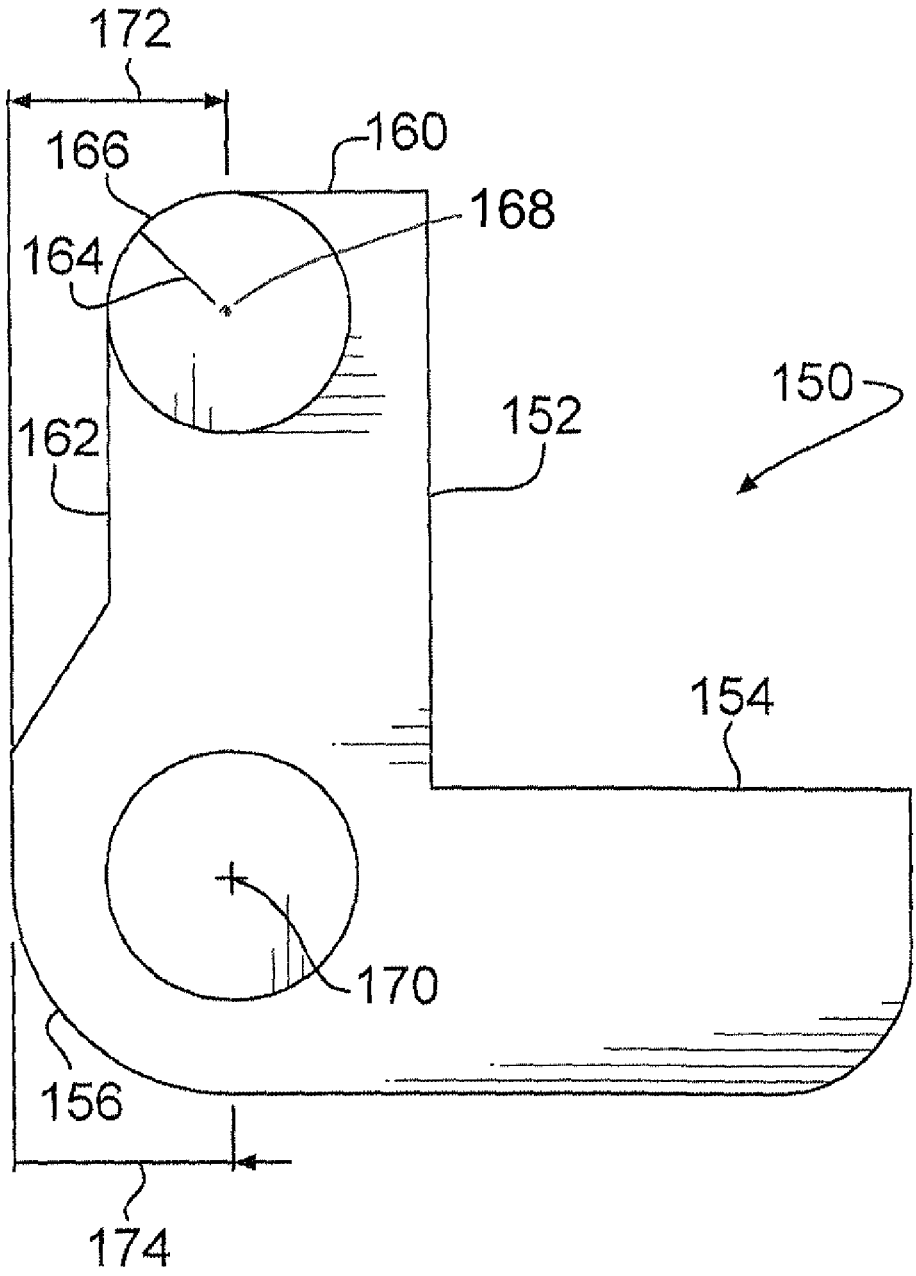
FIG. 6 is a side view of an alternate example of the lock lever according to the invention.

In an alternate example as shown in FIG. 6, the provision of a second radius as described in the example above is eliminated. In this example, the problem with past designs of lock levers is again alleviated, relating to the lock lever causing the platform to be raised 0.020 to 0.030 inches higher than the desired position, until the lock lever rotates to the final position. In this example, the lock lever 150 again has a first leg 152 and second leg 154, and a corner region with a mounting aperture 156 about which the lever 150 rotates. The lock lever 150 is positioned by a concentric shoulder bolt as previously described. As the lock lever 150 is rotated as previously described, an upper engagement surface 160 associated with leg 152 is substantially horizontally disposed, and engages as described with reference to the description of FIG. 1, the bottom surface of an offset base member 60 associated with and secured to the cylinder assembly 12. The positioning of engagement surface 160 controls the position of the base member 60 (FIG. 1) and in turn the position or height of the cylinder assembly 12 and associated platform (not shown) on which a can or container is positioned for filling. This height or position of the engagement surface 160 is designed to be at a predetermined height within a predetermined tolerance for proper operation of the filling machine. In this example, the locking lever 150 has an offset portion 162 associated with the outer surface of leg 152, which extends from a position adjacent the corner portion 156. The offset portion 162 is dimensioned such that the radius 164 is positioned to prevent over travel caused by the rotation surface 166. The radius 164 is a predetermined radius that blends into the flat plane of engagement surface 160. The center 168 of the radius 164 is therefore offset a dimension 172 from the center of rotation 170 associated with the pivot corner 156. In an example, the dimension 172 may be 0.60 inches from the outer surface of the corner 156, while the center of rotation 170 is and dimension 174 may be 0.625 inches. As the lock lever 150 rotates, no over travel is imposed on the mating surface of the lift cylinder assembly and associated platform. The second radius of the prior example is also eliminated in this example. In this example, the offset portion 162 forms a first engagement surface on a side of the second leg which transitions to the second engagement surface 160 at the distal end of the second leg. The lock lever being selectively rotated between operational and non-operational positions, and wherein the first engagement surface is offset a predetermined amount from the center of pivoting the lever 150 at 170.

Although the invention has been particularly shown and described with reference to examples thereof, it will be understood by those skilled in the art that changes in form and detail may be made therein without departing from the spirit and scope of the invention.

What is claimed is:

1. A lock lever for use in an automatic beverage machine for filling cans, comprising a lock lever having an L-shaped configuration with a first and second leg, and a first engagement surface on a side of the second leg which transitions to a second engagement surface at the distal end of the second leg, with the lock lever being selectively rotated between operational and non-operational positions, and wherein the transition from the first engagement surface to the second engagement surface positions the second engagement surface at a predetermined height wherein during rotation, no portion of the lock lever extends above the predetermined height.

2. A lock lever according to claim 1, wherein the first engagement surface transitions into the second engagement surface using a first radius and a second radius, with the second radius being different than the first radius.

3. A lock lever according to claim 2, wherein the second radius blends between the first radius and the second engagement surface.

4. A lock lever according to claim 2, wherein the first radius extends from a position adjacent the corner between the first and second engagement surfaces, and the second radius extends from the rotational axis of the lock lever.

5. A lock lever according to claim 4, wherein the second radius is selected to be slightly larger than the dimension between the rotational axis and the second engagement surface of the lock lever.

6. A lock lever according to claim 5, wherein the second radius is related to the dimension between the rotational axis and the second engagement surface of the lock lever and is the same or greater than the dimension between the rotational axis and the second engagement surface by an amount up to 0.015 inches.

7. A lock lever according to claim 1, wherein the first engagement surface is offset a predetermined dimension from an outer surface.

8. A lock lever according to claim 7, wherein the offset dimension is approximately 0.25 inches.

* * * * *